US011158494B2

(12) United States Patent
Grinfeld et al.

(10) Patent No.: US 11,158,494 B2
(45) Date of Patent: Oct. 26, 2021

(54) ION FRONT TILT CORRECTION FOR TIME OF FLIGHT (TOF) MASS SPECTROMETER

(71) Applicant: Thermo Fisher Scientific (Bremen) GmbH, Bremen (DE)

(72) Inventors: Dmitry Grinfeld, Bremen (DE); Christian Hock, Bremen (DE); Hamish Stewart, Bremen (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 16/418,474

(22) Filed: May 21, 2019

(65) Prior Publication Data

US 2019/0362955 A1 Nov. 28, 2019

(30) Foreign Application Priority Data

May 23, 2018 (GB) ..... 1808459

(51) Int. Cl.
*H01J 49/00* (2006.01)
*H01J 49/06* (2006.01)
*H01J 49/40* (2006.01)

(52) U.S. Cl.
CPC ..... *H01J 49/061* (2013.01); *H01J 49/40* (2013.01)

(58) Field of Classification Search
USPC ..... 250/282
See application file for complete search history.

(56) References Cited

U.S. PATENT DOCUMENTS

| | | | | |
|---|---|---|---|---|
| 5,654,544 | A * | 8/1997 | Dresch | H01J 49/025 250/283 |
| 7,772,547 | B2 * | 8/2010 | Verentchikov | H01J 49/406 250/287 |
| 8,772,708 | B2 * | 7/2014 | Kinugawa | G01N 27/62 250/287 |
| 9,136,101 | B2 * | 9/2015 | Grinfeld | H01J 49/0027 |
| 9,627,190 | B2 * | 4/2017 | Zaks | H01J 49/06 |
| 10,269,549 | B2 * | 4/2019 | Stewart | H01J 49/063 |
| 10,416,131 | B2 * | 9/2019 | Verenchikov | H01J 49/061 |
| 2017/0098533 | A1 | 4/2017 | Stewart et al. | |

FOREIGN PATENT DOCUMENTS

| | | |
|---|---|---|
| CN | 103165395 A | 6/2013 |
| CN | 103165395 A | 6/2013 |
| GB | 2489094 A | 9/2012 |
| GB | 2489094 A | 9/2012 |

OTHER PUBLICATIONS

Combined Search and Examination report dated Oct. 8, 2018 to GB Patent Application No. 1808459.0.
Combined Search and Examination Report dated Oct. 29, 2019, for GB Application No. 1906954.1.

* cited by examiner

*Primary Examiner* — Phillip A Johnston

(57) ABSTRACT

Correction of an angle of tilt of an ion beam front in a Time of Flight (TOF) mass spectrometer is described. In one aspect, an ion beam front tilt corrector can include an electrode that, when applied with a voltage, defines an equipotential channel of particular dimensions to allow for ions in different transverse positions along a transverse axis of the equipotential channel to have different traversal times.

22 Claims, 6 Drawing Sheets

ION FRONT TILT CORRECTION FOR TIME OF FLIGHT (TOF) MASS SPECTROMETER

PRIORITY INFORMATION

This application claims the benefit of GB patent application no. 1808459.0, filed May 23, 2018. The content of this application is incorporated by reference in its entirety.

FIELD OF THE INVENTION

This invention relates to the correction of the angle of tilt of an ion front in a Time of Flight (TOF) mass spectrometer.

BACKGROUND TO THE INVENTION

Time-of-flight (TOF) mass spectrometers with ion-impact detectors utilize the property that the travelling time of an ion in an electrostatic field is proportional to the square root of the ion's mass. Ions are ejected simultaneously from an ion source (e.g. an orthogonal accelerator or a radio-frequency ion trap), accelerated to a desirable energy, and impinge on an ion detector (e.g. a micro-channel plate) upon traveling a specified distance. With the travelling distance substantially the same for all ions, the ion arrival time is used to determine the mass-to-charge ratio m/q, which is later used for ion identification.

Accuracy of the mass/charge measurement and the quality of mass separation depend on the travelling time spread for ions of same mass-to-charge ratio m/q. This spread originates from different starting conditions, coordinates and velocities, and a limited ability of a mass spectrometer to focus ion bunches in time, that is to bring same m/q ions simultaneously to a detector regardless of their starting conditions.

Time focusing with respect to the ion energy is normally achieved with one or more electrostatic mirrors as in the reflectron-type mass analyzers (Mamyrin B. A., et al. Sov. Phys.-JETP, 37, pp. 45-48, 1973). Time focusing with respect to initial coordinates and velocities may be achieved by different means. In the earliest reflectrons with grids, a uniform electrostatic field was used for ion reflection which guaranteed the time-of-flight independence on the lateral starting coordinates and velocities. In more sophisticated mass analyzers with gridless ion mirrors, the field configuration is specially designed to eliminate the most prominent spatial-time aberrations. Such configurations were found for axisymmetrical mirrors (H. Wollnik and A. Casares, Int. J. of Mass Spectrom. 227 (2), 217-222, 2003) and planar mirrors (Yavor M., et al., Physics Procedia 1, pp. 391-400, 2008). Electrostatic sectors—to focus ions both spatially and temporally—were also used (Satoh T., J. Mass Spectrom. Soc. Jpn., 57 (5), pp. 363-369, 2009).

In all of these arrangements, the ion bunches spatially diverge while travelling from an ion source, and their transverse dimension may reach several millimeters when impinging on a detector. A spatially extended ion bunch is also beneficial to reduce space-charge effects and prevent the detector's saturation. The latter is especially important for micro-channel plate (MCP) detectors and dynode detectors. A negative effect of a wide ion impingement area is that it places particularly strict requirements upon the detector alignment with respect to the incident ion beam. Indeed, for an ion bunch of width 10 mm, even small angular misalignment of a detector (for example, one angular degree) results in ~0.17 mm difference in the ion impingement times. Given the total ion travelling distance of 1 meter, this discrepancy limits the mass resolving power of the mass analyzer by the value of R=1 meter/0.170 mm/2≈3000, which is usually unacceptable.

The problem of detector alignment is also exacerbated by the fact that an actual TOF front (a locus, usually a plane but sometimes a curved surface, where ions with different lateral starting conditions arrive simultaneously) is affected by misalignments of other ion-optical elements, e.g. the ion source and/or mirrors, as well as factors such as fringe electric field and stray magnetic fields in the instrument's environment, each of which is difficult to predict. As a result, precise alignment of an ion detector and the TOF front is a difficult engineering challenge.

A number of solutions have been proposed to address the problems set out above. U.S. Pat. No. 5,654,544 (Dresch) discloses the precise mechanical control of an ion detector to fit its ion-sensitive plane to an actual TOF front of an incident ion bunch. Such an approach is, however, difficult to implement because the moving parts require an activator for their precise adjustment.

Electrically controlled methods are preferable because they allow precise tuning during the mass spectrometer's operation. It was proposed in US-A-2017/0098533 (Stewart et al.) to use a dipolar electric field to rotate the TOF front and align it with an ion impact detector. The position and the orientation of the detector are fixed. This method utilizes a property of the transverse dipolar electric field to tilt the TOF front in a direction opposed to that of the deflection. The effect originates from the velocity difference for ions that pass in the vicinity of a positive pole and ions that pass near to a negative pole of a dipolar electrostatic element. This difference produces a correlation between the ion's position and the time of arrival at a detector, which is located immediately behind the dipolar element.

U.S. Pat. No. 7,772,547 (Verentchikov, see FIGS. 3 and 4) and U.S. Pat. No. 9,136,102 (Grinfeld et al., see FIGS. 11A and 11B) also disclose TOF front rotation using a dipolar electric field for preparation of the ion beam before it enters a TOF mass analyzer.

A limitation of a TOF front corrector with a dipolar field is that this field is never perfectly uniform, resulting in significant and unavoidable distortions at the entrance and exit of the electrostatic dipolar element. The presence of the surface of an equipotential detector in the immediate vicinity of a dipolar element also contributes to such field perturbations. Because of the field imperfections, the net time-of-flight correction is not exactly linear with respect to the ion's entrance coordinate, which leads a distortion of the TOF front.

It is proposed in US-A-2014/0054454 (Noyes et al.) to correct the TOF front misalignment using a system of flat meshes that are angled with respect to each other and biased with different accelerating or decelerating potentials. Ion bunches cross all of the meshes sequentially. When the distance between two adjacent meshes and their mutual tilt are small enough, the electric field between the meshes is quasi-uniform and changes linearly in the direction of the tilt. The time taken for a particular ion to cross the stack of meshes differs according to where the ion enters the stack. The TOF front is, therefore, rotated to match the detector. Crossing several meshes leads, however, to significant ion losses and scattering. Moreover, ion collisions with the mesh wires result in ion fragmentation and possible sputtering of the mesh material; the charged and neutral fragments may hit the detector producing false peaks.

Against this background, the present invention proposes solutions to the problems associated with the time of flight front tilt.

SUMMARY OF THE INVENTION

In accordance with a first aspect of the present invention, there is provided a time of flight (TOF) ion beam front tilt corrector in accordance with claim 1.

The corrector incorporates one or more electrodes, preferably a stack of several electrodes, with channels. An electrode as described realizes a region of a substantially equal electric potential inside its channel. If the full ion energy per a unit charge is $U_0$ and the potential of the k-th electrode is $U_k$, the ion's kinetic energy is $U_0$-$U_k$ per unit charge when the ion flies inside the channel.

The period of time for the ion to traverse a channel with a length $L_k$ in the direction Z of the ion motion is:

$$T_k=L_k(M/2q)^{1/2}/(U_0-U_k)^{1/2}. \quad (1)$$

At least one electrode of the corrector has a channel length that varies in a direction transverse to the Z axis, that is to say, the channel length $\Delta Z=L_k(X,Y)$ differs depending on the position X, Y of the ion as it enters the channel. As a result, the time T of a particular ion's crossing of the stack of electrodes depends on the transversal ion's position ($X_{TC}$, $Y_{TC}$), thus causing the time-of-flight difference which compensates for the time-of-flight error.

In multiple practical designs, the tilt of a TOF front in a first direction is more significant than its tilt in a second, orthogonal direction, for example when the second direction is orthogonal to a plane of symmetry of the mass analyzer. In that case, the tilt need only be addressed in the first direction and can be ignored in the orthogonal direction. This is also the case when the ion bunch is elongated in one direction more than in the other direction, and the second direction is therefore more forgiving to the tilt. Both situations are typical, for example, of TOF mass analyzers with planar ion mirrors as described in the Soviet Union patent SU 1725289 (Nazarenko L. M., et al.), U.S. Pat. No. 7,385,187 B2 (Verentchikov et. al), or U.S. Pat. No. 9,136,102 B2 (Grinfeld D., Makarov A.). When the ion bunch arrives at a detector, its width in the direction orthogonal to the ion mirrors' plane of symmetry is relatively small, while the spread along the mirrors is high. The TOF front correction is most important in the direction where the ion beam is wider.

In contrast with the arrangement shown in the aforementioned US-A-2014/0054454, the TOF ion beam front tilt corrector of the present invention does not require a mesh to adjust the tilt of the ion beam front.

In a preferred embodiment, the ion beam is spread in the $X_I$ direction of the plane perpendicular to the axis of ion motion $Z_I$ that case, in comparison with the beam dimension in the $Y_I$ direction of that orthogonal plane. In accordance with the foregoing discussion, the ion beam front tilt corrector is preferably then configured to address only the tilt in that $X_I$ direction, with any tilt in the $Y_I$ direction being ignored as contributing less to the TOF error.

In that case, the angle γ of the TOF front rotation introduced by the ion beam front tilt corrector can be expressed mathematically in terms of the $X_{TC}$ axis only as:

$$\tan\gamma(X_{TC}) = T'v_z = \sum_{k=1}^{K}\sqrt{\frac{U_0}{U_0-U_k}}\,L_k'(X_{TC}) \quad (2)$$

where ' (prime) denotes a derivative with respect to the coordinate $X_{TC}$ and $v_z=(2qU_0/m)^{1/2}$ is the velocity at which an ion enters the stack of K electrodes with voltages $U_1 \ldots U_K$.

In further preferred embodiments, the TOF ion beam front tilt corrector may comprise a stack of K electrodes spaced apart along the longitudinal $Z_{TC}$ axis, each electrode defining a channel, with the channel defined by each electrode being at least partially aligned with the others so that ions in the ion beam entering a first, upstream electrode are able to traverse the plurality of spaced electrodes via their at least partially aligned channels and exit the TOF ion beam front tilt corrector with the beam front angle having been shifted relative to the $Z_{TC}$ axis. In that case, the expression (1) for $T_k$ set out above may be generalised; the total time to cross the stack of K electrodes is then $$T = \sqrt{\frac{m}{2q}}\sum_{k=1}^{K}\frac{L_k}{\sqrt{U_0-U_k}} \quad (3)$$

where $L_k$ is the length of the channel in the km electrode.

The or each channel preferably has a generally rectangular section in planes perpendicular to the $Z_{TC}$ direction. The shorter dimension (in the example above, the $Y_{TC}$ direction) of the or each channel is sufficiently wide to accommodate the transversal width of the bunches of ions in the ion beam.

Alternatively, the electrode (or some/all of the electrodes when a plurality is present) comprises two equipotential parts located at a distance from each other, and which are substantially parallel to each other. The gap between the equipotential parts forms the channel through which the ion beam passes.

In preferred embodiments, where the TOF ion beam front tilt corrector comprises a plurality of electrodes arranged in a stack, there are narrow gaps between adjacent electrodes.

An ion-impact detector may preferably be located downstream of the TOF ion beam front tilt corrector.

In some embodiments the electrode is wedge-shaped, with the electrode defining a first opening in a plane perpendicular to the $Z_{TC}$ axis in an $X_{TC}$-$Y_{TC}$ plane, and a second opening spaced from the first opening and formed in a second plane tilted relative to the plane of the first opening. In other embodiments, the planes of both first and the second openings are tilted relative to the $X_{TC}$-$Y_{TC}$ plane. In the example above, where the ion beam is spread in the $X_I$ direction relative to the $Y_I$ direction, the plane of the second opening of the channel defined by the electrode may include the $Y_{TC}$ axis but lie at an angle α to the $X_{TC}$ axis. The channel length in the $Z_{TC}$ direction is, therefore, a substantially linear function of the transversal coordinate $X_{TC}$, and $dL_k/dX_{TC}$ is a constant. In such embodiments the TOF front correction is described by a uniform rotation by the angle γ.

In other embodiments, however, either the first opening, the second opening or both of the at least one electrode may be curved. For example, the first opening may be planar (e.g., in the $X_{TC}$-$Y_{TC}$ plane perpendicular to the $Z_{TC}$ axis), whilst the second opening may again include the $Y_{TC}$ axis but follow a curved line in $X_{TC}$-$Z_{TC}$ planes). Then the function $dL_k(X_{TC})/dX_{TC}$ is nonlinear. Such an embodiment is, for example, capable of correcting a curved TOF beam front distortion.

In preferred embodiments, the TOF ion beam front tilt corrector includes first and second electrodes positioned adjacent to each other in the $Z_{TC}$ direction. Each electrode may have a first opening in a plane perpendicular to the $Z_{TC}$ axis in an $X_{TC}$-$Y_{TC}$ plane, and a second opening spaced from the first opening and formed either in a second plane tilted relative to the plane of the first opening, or defining an opening including the $Y_{TC}$ axis with a curved line in the $X_{TC}$-$Z_{TC}$ planes. In either case, the second openings are opposed to one another. In the case that the second openings each define a tilted plane, the angle of tilt of the plane of the second opening in a first of the electrodes may be formed at an angle $+\alpha$ whilst the angle of tilt of the plane of the opposed second opening in the second of the electrodes may be formed at an angle $-\alpha$. In the case that the second openings are each curved, the second opening in the first of the electrodes may be generally convex whilst the second, opposed opening in the second of the electrodes may be generally concave.

The or each electrode may be electrically biased with accelerating or decelerating voltages $U_k$ that may be tuned during operation or maintenance in order to rectify the TOF fronts of impinging ion bunches and align them with a sensitive surface of an ion detector, e.g. a micro-channel plate. Further aspects of the invention provide an ion detection system as set out in claim 16, and a TOF mass spectrometer including such an ion detection system, as defined in claim 18.

In still a further aspect of the invention, there is provided a method of correcting the tilt of an ion beam front in a time of flight (TOF) mass spectrometer in accordance with claim 19.

According to another aspect of the invention there is provided a time of flight (TOF) ion beam front tilt corrector, comprising at least one electrode which, when supplied with a voltage, defines a substantially equipotential channel, the channel extending in a longitudinal direction Z which is generally parallel with the direction of travel of ions in the ion beam, and in a direction X orthogonal to that longitudinal direction Z; wherein the length of the channel in the longitudinal direction Z varies in accordance with the transverse position in the direction X orthogonal to the said direction of travel of ions within the channel, so that ions at a first transverse position X in the ion beam spend a different amount of time traversing the channel of the at least one electrode, to ions in a second, different transverse position X of the ion beam.

In still a further aspect of the invention there is provided a method of correcting the tilt of an ion beam front in a time of flight (TOF) mass spectrometer, comprising (a) in an ion source, generating an ion beam having a beam axis Z along a direction of travel in the TOF mass spectrometer, the ion beam having a width and a height in an X-Y plane perpendicular to the Z axis; (b) directing the ion beam towards an ion detector at a location in the TOF mass spectrometer downstream of the ion source; and (c) directing the ion beam through a TOF ion beam front tilt corrector located between the ion source and the ion detector, the TOF ion beam front tilt corrector comprising at least one electrode defining a channel extending in both the Z axis and also in the X-Y plane, the length of the channel in the Z axis direction varying in accordance with the position in the channel in the orthogonal X-Y plane; the method further comprising applying a voltage to the at least one electrode of the TOF ion beam front tilt corrector, so as to generate a substantially equipotential channel defined by the electrode, whereby ions in the ion beam at different locations in the X-Y plane experience the substantial equipotential in the electrode channel for different lengths of time as they pass through the channel, so as to shift the locus of the plane of the ion beam front relative to the Z axis as ions pass through the TOF ion beam front tilt corrector.

Further preferred features are set out in the dependent claims.

BRIEF DESCRIPTION OF THE DRAWINGS

The invention may be put into practice in a number of ways and some specific embodiments will now be described by way of example only and with reference to the accompanying drawings in which.

DETAILED DESCRIPTION OF PREFERRED EMBODIMENTS

Figure 1:
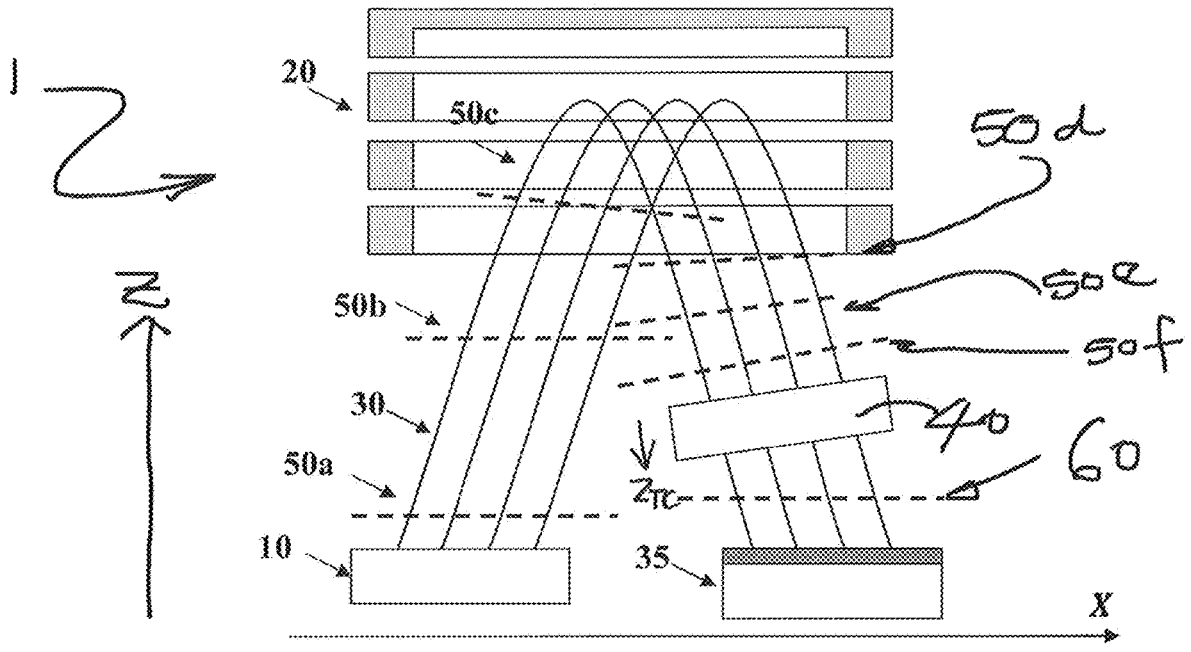
FIG. 1 shows a schematic representation of a time of flight (TOF) mass spectrometer embodying an aspect of the invention and including a TOF ion beam front tilt corrector.

Referring first to FIG. 1, a schematic representation of a TOF mass spectrometer 1 embodying an aspect of the present invention is shown. The spectrometer 1 illustrated in FIG. 1 is of the "reflectron" type.

The TOF mass spectrometer 1 consists of a pulsed ion source 10, an ion mirror 20, a time-resolving ion-impact detector 35, and a TOF ion beam front tilt corrector 40 situated between the ion mirror 30 and the ion-impact detector 35. The ion source 10 and the ion impact detector 35 are formed in an X-Y plane (the Y direction is formed into and out of the plane of the page in FIG. 1). Ions originate from the ion source 10 as a series of pulses having a beam axis $Z_I$ which have a relatively broad cross sectional profile in an $X_I$ direction perpendicular to the beam axis $Z_I$ which is nearly parallel with the X axis of the X-Y plane, relative to the $Y_I$ direction perpendicular to the $X_I$ and the direction of the beam axis $Z_I$. In other words, in the illustrated example the cross section of each ion pulse may for example be elliptical, with a major axis in the $X_I$ direction and a minor axis of the ellipse in the $Y_I$ direction.

The spectrometer 1 defines a longitudinal Z direction which is orthogonal to the X and Y axes. Ions in each pulse leave the ion source 10 as an ion beam 30 formed of a series of pulses. Typically, the beam axis 1 deviates only by a small angle from the Z direction. The ion beam 30 travels towards the downstream ion mirror 20 in the direction of the beam axis 1 which lies at an acute angle to the longitudinal axis (+Z direction), where the ion pulses are reflected by the ion mirror 20 and back in a direction at an acute angle to the longitudinal axis (−Z direction). The ions pass through the TOF ion beam front tilt corrector 40 (to be described in detail below) and then impinge upon the ion-impact detector as bunches of ions separated in time of flight in accordance with their mass to charge ratio m/z.

Ions leave simultaneously from the ion source 10 (although spread out along the $X_I$ direction, and with a minor extent in the $Y_I$ direction). The plane of the beam front is illustrated in FIG. 1 as a series of dashes labelled 50*a*. The plane of the beam front as it leaves the ion source 10 thus lies in the X-Y plane, orthogonal with the Z direction shown in FIG. 1. As explained in the Background section above, it is desirable that the plane of the beam front should remain orthogonal to the axis Z until the ions impinge upon the ion impact detector 35. Misalignments of the ion-optical components (e.g. in the ion mirror 20 and in other optical components, like lenses, not shown in FIG. 1) as well as field perturbations, e.g. fringe fields, may, however, have an uneven effect upon the ion velocities across the ion beam 30. This results in the beam front arriving at the ion impact detector 35 being tilted at a non zero angle in the X-Z plane relative to the detector's plane, such that ions from the same pulse, and having the same m/z, strike the ion impact detector at different times depending upon their lateral position across the beam width. Since the mass to charge ratio is related to the detected time of flight, the result is that the mass resolution and accuracy are reduced as the time of impact of a particular pulse upon the ion impact detector is spread out.

The progression of the beam front as a consequence of misalignments, perturbations and other electro-mechanical factors is shown in FIG. 1, as the ions progress through the ion mirror 20 up to the TOF ion beam front tilt corrector 40. The plane of the beam front 50*b* of the ion beam 30 is originally orthogonal to the Z axis upon ejection from the ion source 10. As the ions pass into the ion mirror 20, however, the beam front starts to tilt (illustrated by the dashed line labelled 50*c*) in the X-Z plane and, as the ions progress through the ion mirror 20 and out the other side towards the TOF ion beam front tilt corrector 40, the tilt in that X-Z plane becomes more significant (see dotted lines 50*d*, 50*e*, 50*f* which each represent the ion beam front tilt).

The purpose of the TOF ion beam front tilt corrector 40 is to correct for the tilt in the ion beam front introduced as the ions pass through the TOF mass spectrometer 1. As may be seen in FIG. 1, the angle of the beam front at a location immediately upstream of the TOF ion beam front tilt corrector 40 (indicated by the dotted line 50*f*) is adjusted by the passage of the ions in the ion beam 30 through the TOF ion beam front tilt corrector 40, so that the beam front at a point immediately downstream of the TOF ion beam front tilt corrector 40 once again lies in an X-Y plane orthogonal to the (−)Z direction in the TOF mass spectrometer 1. This is illustrated by the dotted line 60 in FIG. 1. Ions then impact the ion impact detector 35 simultaneously across the extent of the ion beam 30 in the X direction, so that the total impact time of the ions in a given pulse is minimized.

Having described the general arrangement of a TOF mass spectrometer 1 including a TOF ion beam front tilt corrector 40 for correcting the angle of the ion beam front 30, some examples of specific TOF ion beam front tilt correctors will now be described with reference to FIGS. 2 to 5

Figure 2:
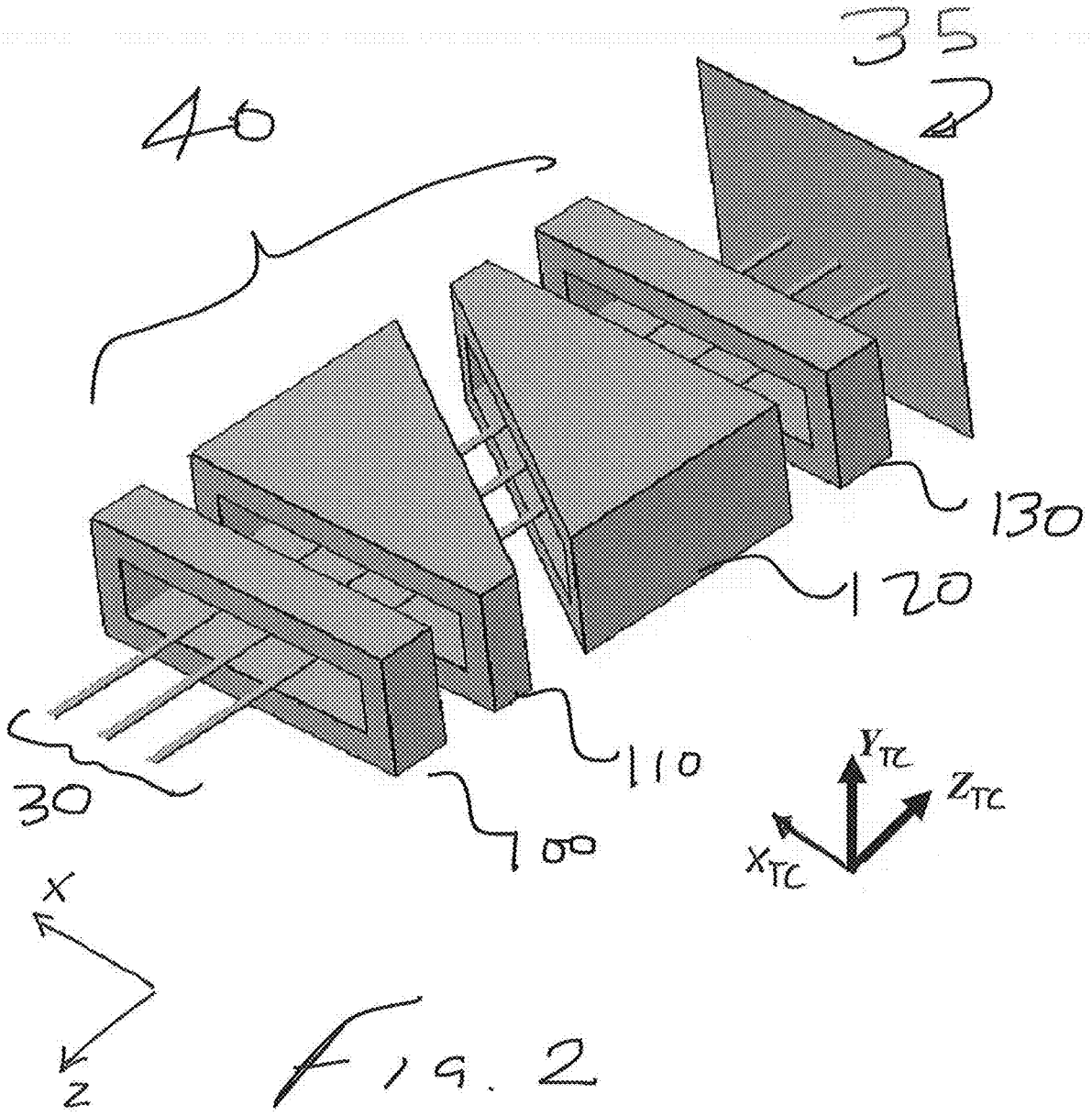
FIG. 2 shows a perspective view of an ion detection system having an ion detector and a TOF ion beam front tilt corrector in accordance with a first embodiment of the invention.

The most common distortion of the TOF front is a tilt where the ion impingement time depends linearly on the transverse coordinate X. A TOF ion beam front tilt corrector 40 suitable for correcting such a linear tilt introduced during passage of the ions through the TOF mass spectrometer 1 is shown in FIG. 2. The TOF ion beam front tilt corrector 40 comprises four electrodes 100, 110, 120 and 130 extending along the longitudinal direction $Z_{TC}$ having an outer surface. Preferably the longitudinal direction is nearly parallel with the Z axis. Preferably the angle between the longitudinal direction $Z_{TC}$ and the (−Z) axis is smaller than 5°, in particular smaller than 2°. Optimally, the angle is below 0.1°. Each electrode has a channel extended in the $X_{TC}$ and $Y_{TC}$ directions defined by the inner surface of the electrode. The $X_{TC}$ and $Y_{TC}$ directions are perpendicular to each other and lie in the $X_{TC}$-$Y_{TC}$ plane which is perpendicular to the longitudinal direction $Z_{TC}$ of the TOF ion beam front tilt corrector. The length of the channel in the $X_{TC}$ direction (of the first axis $X_{TC}$) relative to the length of the channel in the $Y_{TC}$ direction (of the second axis $Y_{TC}$) is elongated to accommodate the extent of the ion beam 30 in each direction due to its cross-sectional profile. The ratio of the first, longer length along a first axis $X_{TC}$ to the second, shorter length along a second axis $Y_{TC}$ is at least 2. Preferably the ratio is between 2 and 10, more preferably between 2.4 and 7 and most preferably between 2.7 and 5. As may be seen in FIG. 2, the first and fourth electrodes 100, 130 are generally rectangular, and define a channel having entrance and exit apertures separated from each other in the $Z_{TC}$ direction but generally lying in parallel planes (each plane being orthogonal to the $Z_{TC}$ direction). The first and fourth electrodes 100, 130 form outer electrodes of the group. Located between the outer electrodes are second and third electrodes 110,120. These electrodes are generally wedge-shaped when viewed in the $X_{TC}$-$Z_{TC}$ plane. In particular, the second electrode 110 lies downstream of the first electrode 100 and has an entrance aperture lying in a plane perpendicular to the Z direction. The second electrode also has an exit aperture spaced from the entrance aperture in the $Z_{TC}$ direction, but which lies in a plane tilted relative to the $Z_{TC}$ axis.

The third electrode 120 also has an entrance and an exit aperture. However, the entrance aperture of the third electrode 120 is tilted at an angle to the $Z_{TC}$ direction. The angle of tilt is preferably the same as the angle of tilt of the exit aperture of the second electrode 110, but with opposite sign: that is to say, if the angle of the exit aperture of the second electrode 110 is defined as $+\alpha$ relative to the $Z_{TC}$ direction, then the angle of the entrance aperture of the third electrode 120 is defined as $-\alpha$.

Thus, the second and third electrodes form a pair of inner electrodes, and there is mirror symmetry between the pair of inner electrodes in a plane lying parallel with the exit aperture of the second electrode 110 and the entrance aperture of the third electrode 120.

The channels of each of the four electrodes 100, 110, 120 and 130 of the TOF ion beam front tilt corrector 40 are each aligned relative to one another in both the $X_{TC}$ and the $Y_{TC}$ directions so that ions are able to pass through the TOF ion beam front tilt corrector 40 from front to back without being impeded by the electrodes themselves. Although in FIG. 2 the apertures and the channels of the electrodes are each completely aligned, it is of course not necessary that the apertures all lie precisely along a single axis, the longitudinal direction $Z_{TC}$, only that they substantially align to allow a direct line of sight through the TOF ion beam front tilt corrector 40.

Preferably—as mentioned above—the electrodes have a channel which is longer in the $X_{TC}$ direction compared with the $Y_{TC}$ direction, taking into account the broader cross section of the ion beam in the X, direction. Embodiments of the invention are in particular contemplated wherein the cross section of the ion beam in the $X_I$ direction is 2 times, preferably 4 times and most preferably 7 times greater than the cross section in the $Y_i$ direction of the ion beam. Preferably the inner surface and/or the outer surface of at least one of the electrodes of the ion beam tilt corrector comprises parallel planes in the $X_{TC}$-$Z_{TC}$ plane. In particular, it is desirable that for at least one of the electrodes of the ion beam tilt corrector additionally the inner surface and/or outer surface comprises parallel planes in the $Y_{TC}$-$Z_{TC}$ planes, so that in particular the electrode or at least the channel of the electrode has a rectangular cross-section in the $X_{TC}$-$Y_{TC}$ plane. Then an entrance or an exit aperture of such an electrode may be rectangular, whether it is not tilted or tilted by a constant angle.

In a preferred embodiment of the ion beam tilt corrector, the inner surface and/or the outer surface of all electrodes of the ion beam tilt corrector comprise parallel planes in the $X_{TC}$-$Z_{TC}$ plane. In a particularly preferably embodiment of the ion beam tilt corrector, the inner surface and/or the outer surface of all electrodes of the ion beam tilt corrector additionally comprise parallel planes in the $Y_{TC}$-$Z_{TC}$ plane, so that in particular each electrode or at least the channel of each electrode has a rectangular cross-section in the $X_{TC}$-$Y_{TC}$ plane. Then, an entrance or an exit aperture of such an electrode may be rectangular, whether it is not tilted, or is tilted by a constant angle.

A power supply (not shown in FIG. 2) provides a potential to the electrodes 100, 110, 120 and 130 of the TOF ion beam front tilt corrector 40. The voltage supplied to each electrode is different in use. This results in ions having different travelling times as they cross the TOF ion beam front tilt corrector 40, depending upon the $X_{TC}$ coordinate of the ions when they enter the TOF ion beam front tilt corrector 40.

Figure 3:
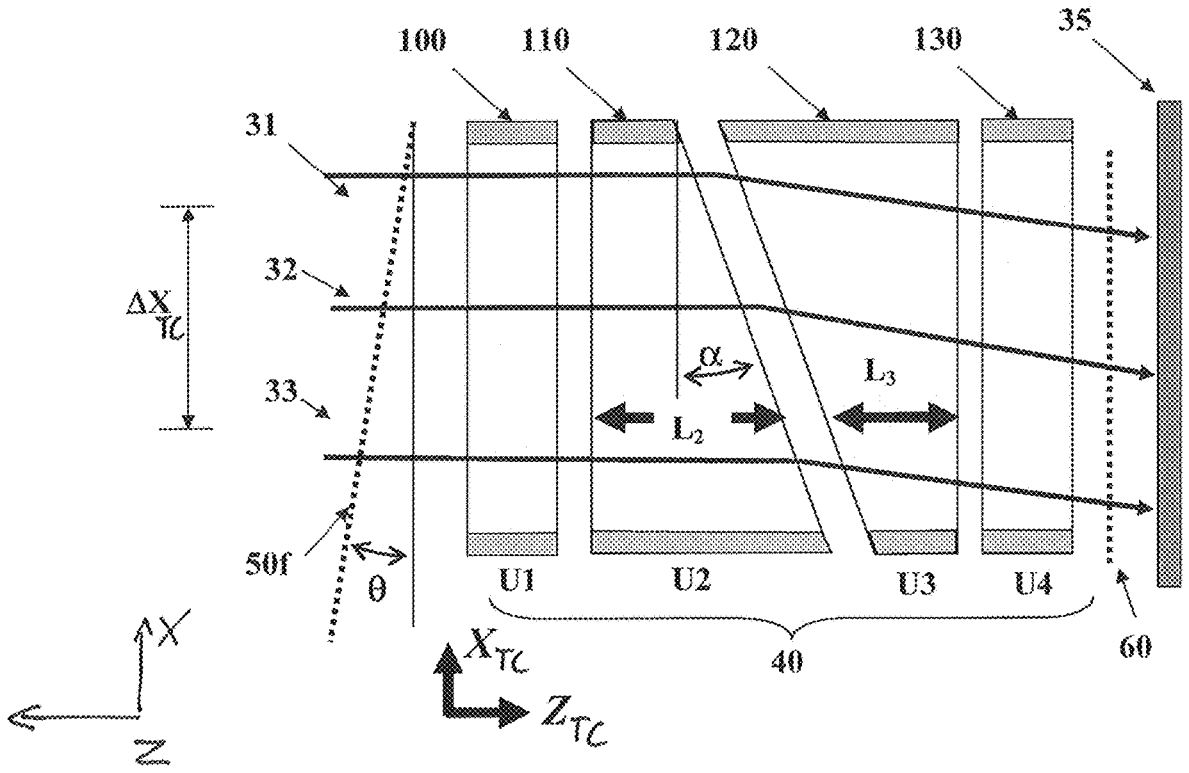
FIG. 3 shows a top sectional view through the ion detection system of FIG. 2.

FIG. 3 shows a plan view in the $X_{TC}$-$Z_{TC}$ plane of the TOF ion beam front tilt corrector 40 of FIG. 2. Ions with substantially the same kinetic energies per unit charge $U_0$ enter the TOF ion beam front tilt corrector 40 at different $X_{TC}$ coordinates across the incident ion beam 30, as shown by trajectories 31, 32 and 33. The ion beam front 50*f* is the plane crossed by all of the ions in the beam 30 simultaneously, at a time t=t1. The beam front 50*f* is tilted with respect to the ion beam detector 35 at an angle θ. Unless corrected, the ions would reach the detector with a time difference $$\Delta T=(m/2qU_0)^{1/2}\Delta X_{TC}\tan\theta,$$

where $\Delta X_{TC}$ is the difference of the entrance coordinates, m is the mass of the ions, and q is their charge.

The potentials applied to the electrodes 100, 110, 120 and 130 of the TOF ion beam front tilt corrector 40 are, respectively, $U_1$-$U_4$. When traveling in a channel of one of the electrodes, an ion is accelerated or decelerated depending upon the sign of the potential of the electrode. Accordingly, the amount of time taken for an individual ion to cross the stack is given by equation (3) above, where the lengths of the wedged electrodes depend linearly on $X_{TC}$ as $L_2=L_{20}-X_{TC}\tan\alpha$ and $L_3=L_{30}+X_{TC}\tan\alpha$; α is the wedge angle and $L_{20}$ and $L_{30}$ are constants.

The time-of-flight difference between two ion trajectories 31 and 33 which are transversally separated by $\Delta X_{TC}$ is then $$\Delta T=\sqrt{\frac{m}{2q}}\left(\frac{1}{\sqrt{U_0-U_2}}-\frac{1}{\sqrt{U_0-U_3}}\right)\Delta X_{TC}\tan\alpha \tag{4}$$

causing the TOF front to rotate by an angle γ expressed as:

$$\tan\gamma=\left(\sqrt{\frac{U_0}{U_0-U_2}}-\sqrt{\frac{U_0}{U_0-U_3}}\right)\tan\alpha \tag{5}$$

The choice of electrode voltages $U_2$ and $U_3$ to satisfy the equality γ=−θ compensates for the initial TOF beam front misalignment and causes ions across the beam front to impinge on the detector simultaneously.

A side effect of the TOF front correction is a deflection of a bunch of ions in the beam, in a direction opposite to the front rotation. However, if the required correction is small, i.e. tan γ<<1, the extra effect on the travelling time can be ignored as the increase is a constant multiplied by $(\tan\gamma)^2$.

Figure 4:
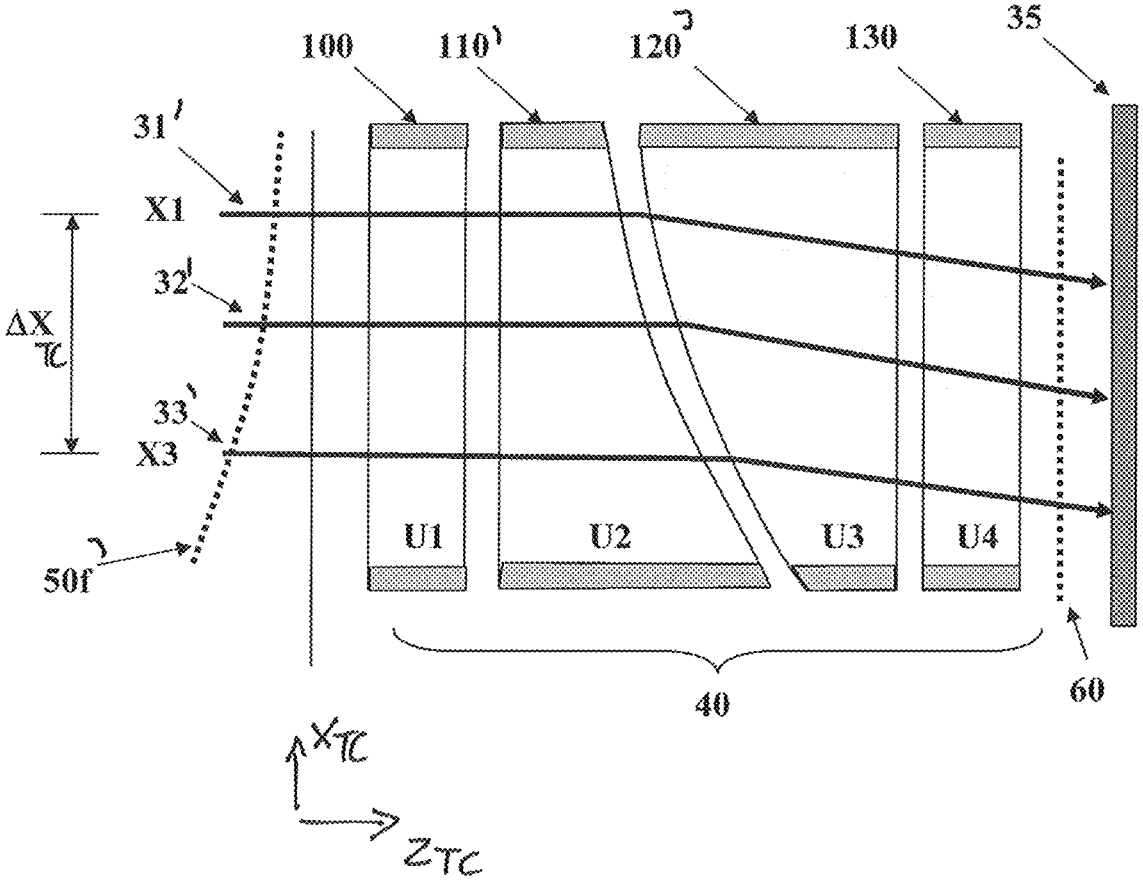
FIG. 4 shows a top sectional view of an ion detection system having an ion detector and a TOF ion beam front tilt corrector in accordance with a second embodiment of the invention.

FIG. 4 shows a plan view in the $X_{TC}$-$Z_{TC}$ plane of a second, alternative embodiment of a TOF ion beam front tilt corrector 40 in accordance with the present invention. The TOF ion beam front tilt corrector 40 generalizes the concept explained above to the case where the geometry and electrostatics of the TOF mass spectrometer introduce a non linear shift to the direction of the beam front so that it is curved as shown by the dotted line 50*f'* which follows the trajectories 31', 32' and 33'.

As with the TOF ion beam front tilt corrector 40 of FIGS. 2 and 3, first and fourth electrodes 100, 130 form a pair of outer electrodes which are rectangular cuboids with entrance and exit apertures lying in parallel planes and defining a channel between them. The two central electrodes 110', 120' are again similar to the central electrodes 110, 120 illustrated in FIGS. 2 and 3, but the opposed faces do not however form flat surfaces in a plane tilted with respect to the $Z_{TC}$ direction but instead form curved surfaces. The exit aperture of the second electrode 110' is, in the example of FIG. 4, generally concave in shape whilst the entrance aperture of the third electrode 120' is generally convex. A curved line of symmetry follows equidistantly between the exit aperture of the second electrode 110' and the entrance aperture of the third electrode 120'.

Again application of differential voltages $U_0$-$U_4$ are applied to the sequential electrodes whose apertures are aligned as described above in connection with FIGS. 2 and 3.

The arrangement of FIG. 4 corrects the curved beam front 50*f'* to a straight beam front 60.

Figure 5:
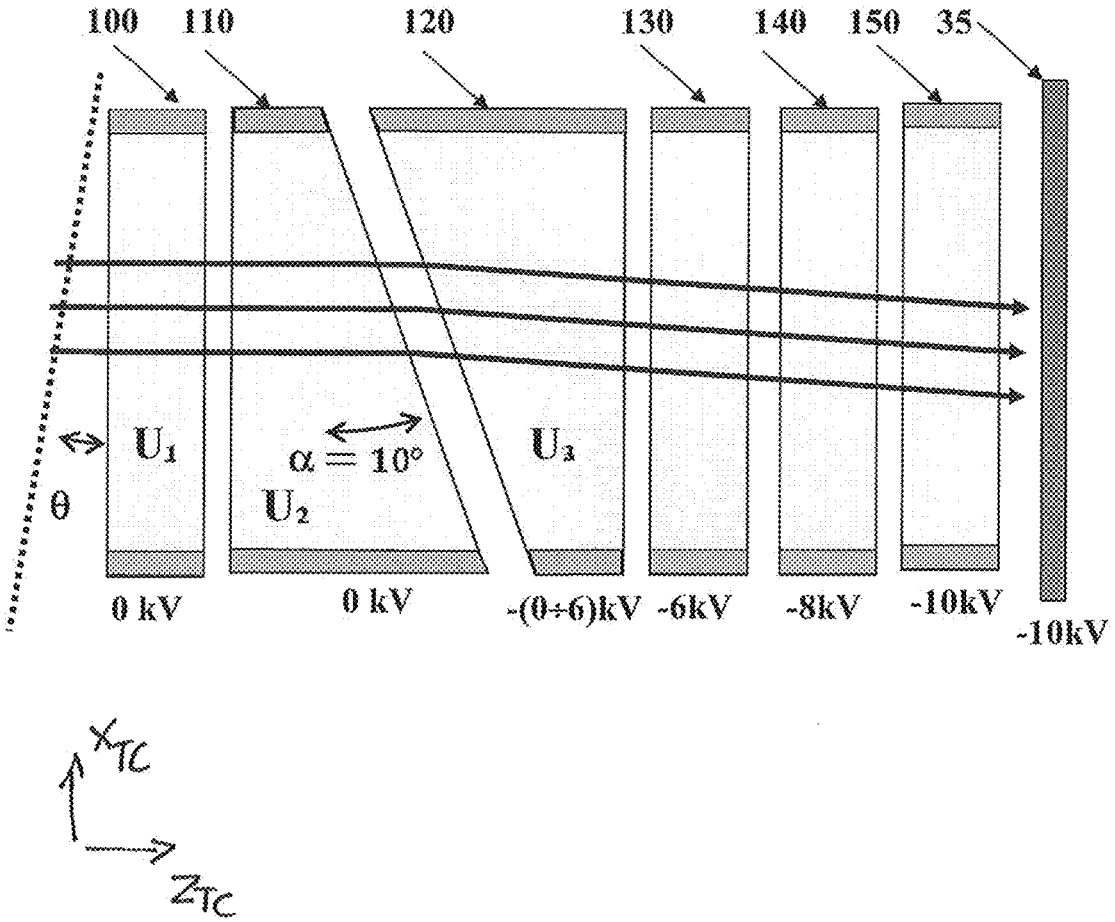
FIG. 5 shows a top sectional view of an ion detection system having an ion detector and a TOF ion beam front tilt corrector in accordance with a third embodiment of the invention.

FIG. 5 shows a schematic plan view of a further preferred embodiment of a TOF ion beam front tilt corrector 40 which is combined with a post-accelerator. The post accelerator increases the kinetic energy of the ions as they impinge upon the ion impact detector 35.

In the embodiment of FIG. 5, the post-accelerator is realized as a plurality of electrodes, each having aligned channels and each being supplied with progressively more negative voltages. In the exemplary arrangement of FIG. 5, the fourth electrode 130 (FIGS. 2, 3 and 4) forming one of the outer electrodes of the TOF ion beam front tilt corrector 40 constitutes a first of the post-accelerator electrodes and is supplied with a relatively lower voltage such as −6 kV. A second of the post-accelerator electrodes is positioned downstream of the first post-accelerator electrode and is supplied with a larger negative potential such as −8 kV. The third and final post-accelerator electrode (in the specific example of FIG. 5) is downstream of the second post-accelerator electrode and is supplied with a potential of −10 kV.

Positive ions that enter the entrance aperture of the first electrode 100 of the TOF ion beam front tilt corrector 40 with an accelerating voltage $U_0$=4 kV, are then further accelerated by 10 kV as they pass through the channels in the subsequent central electrodes 110, 120, the fourth electrode 130 of the TOF ion beam front tilt corrector 40 (which in the embodiment of FIG. 5 also constitutes the first of the ion beam post-accelerator electrodes), and the second and third post-accelerator electrodes 140, 150. The potential applied to the ion impact detector 35 is the same as that applied to the third post-accelerator electrode 150, i.e. in the present example, −10 kV. This means that there is no accelerating or decelerating electric field between the exit of the TOF ion beam front tilt corrector 40 and the ion impact detector 35.

In the example of FIG. 5, the exit apertures of the central electrodes 110 and 120 are tilted at an angle $\alpha$=10° to the Z direction.

The voltage $U_3$ applied to the third electrode 120 (the second of the central electrodes in the TOF ion beam front tilt corrector 40) may be chosen to compensate the initial TOF front misalignment $\theta$. Table 1 shows the optimal value for $U_3$ to compensate a given misalignment $\theta$.

TABLE 1

| Optimal Value for $U_3$ | |
|---|---|
| wedged electrode voltage $U_3$, kV | compensated $\theta$, degrees |
| −1 | 1.07 |
| −2 | 1.85 |
| −3 | 2.46 |
| −4 | 2.96 |
| −5 | 3.37 |
| −6 | 3.71 |

Although some specific embodiments have been described, it will be understood that these are merely for the purposes of illustration and that various modifications or alternatives may be contemplated by the skilled person. For example, the TOF mass spectrometer illustrated in FIG. 1 is of the "reflectron" type but it is to be understood that this is merely exemplary and that the invention is equally applicable to other forms of TOF mass spectrometer such as a multi reflection TOF (mr-TOF). In that case, the TOF ion beam front corrector may be positioned in front of the ion detector so as to correct for beam front tilt after the ions have been reflected multiple times between the mirrors in the mr-TOF, or alternatively the TOF ion beam front corrector could be positioned within the flight path between the mirrors of the mr-TOF. In that case, the voltage supplied to the electrodes of the TOF ion beam front corrector may be controlled by the system controller so as to correct the ion beam front angle each time that ion bunches fly through the channels of the TOF ion beam front corrector.

Furthermore, the specific position of the TOF ion beam front tilt corrector 40 within the flight path of the ions from the ion source 10 to the ion impact detector 35 is not limited to the position illustrated in the Figures in particular. As will be understood, the electro-mechanical effects upon the direction of the ion beam front relative to the surface of the ion impact detector 35 are typically cumulative as the ions travel through the TOF mass spectrometer, that is to say, the total amount of tilt (expressed as an angle $\theta$) increases from a minimum at the ion source 10 to a maximum (if left uncorrected) at the ion impact detector 35. On that basis, it is desirable (though not essential) to position the TOF ion beam front tilt corrector 40 as close to the ion impact detector 35 as possible, so that there is a minimal distance to reintroduce further ion beam front tilt following beam front correction in the TOF ion beam front tilt corrector 40 before the ion beam strikes the ion impact detector 35. It is undesirable that the TOF ion beam front tilt corrector 40 be positioned between the ion source 10 and the ion mirror 20 in view of the degree of tilt introduced by field perturbations and so forth within the ion mirror 20.

Finally, although the embodiment of FIG. 5 incorporates a post accelerator into the TOF ion beam front tilt corrector 40, it will be understood that the post accelerator need not form a part of the TOF ion beam front tilt corrector 40. The post-accelerator may instead be positioned between the TOF ion beam front tilt corrector 40 and the ion impact detector 35, but as a separate unit (with a relatively short or a relatively long flight distance between the TOF ion beam front tilt corrector 40 and the post-accelerator). Alternatively the post-accelerator may be positioned upstream of the TOF ion beam front tilt corrector 40, either forming a part of that corrector 40, or alternatively again being physically separated from it by a relatively short or relatively long distance. For example the post-accelerator could be positioned between the ion mirror 20 and the TOF ion beam front tilt corrector 40, or between the ion source 10 and the ion mirror 20.

The ion beam front tilt corrector described herein is specifically adapted for ion beams having a cross-section which is elongated in one direction ($X_I$ direction). Due to the elongation of the electrodes in the $X_{TC}$ direction, which are at least nearly parallel to the $X_I$ direction of the ion beam when the ions pass the ion beam front tilt corrector, a tilt correction can be provided in an accurate way over the whole beam. In particular it is advantageous when the electrodes of the tilt corrector comprise parallel surfaces in the $X_{TC}$-$Z_{TC}$ plane. In the best case, a very accurate tilt correction can be achieved by a rectangular cross section of the electrodes perpendicular to the longitudinal direction $Z_{TC}$.

Figure 6A:
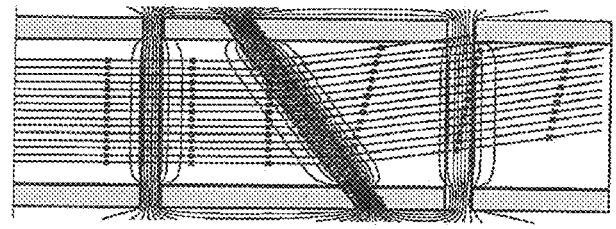
FIG. 6*a* shows the equipotential lines of the electric field of a tilt corrector with a first rectangular cross section of the electrodes.
Figure 6A:
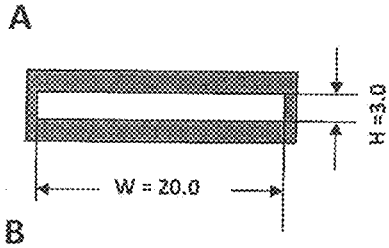
Figure 6B:
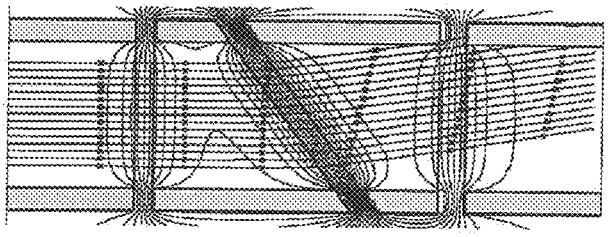
FIG. 6*b* shows the equipotential lines of the electric field of a tilt corrector with a second rectangular cross section of the electrodes.
Figure 6B:
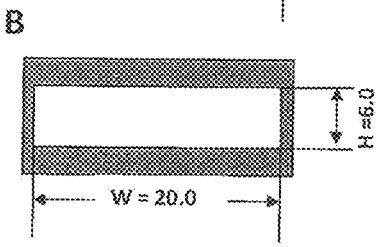
Figure 6C:
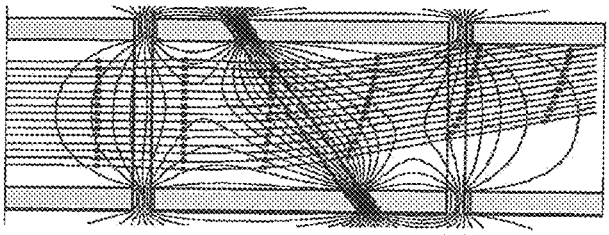
FIG. 6*c* shows the equipotential lines of the electric field of a tilt corrector with a circular cross section of the electrodes.
Figure 6C:
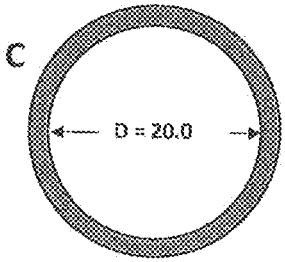

FIGS. 6*a*, 6*b* and 6*c* show the equipotential lines of the electric field for a tilt corrector with different cross sections of the electrodes. In particular, FIGS. 6*a* and 6*b* show the equipotential lines of the electric field for a tilt corrector with electrodes having different rectangular cross-sections. In FIG. 6*a*, the ratio of the first, longer distance W along a first axis $X_{TC}$ to a second, shorter distance H along a second axis $Y_{TC}$ is 6.67. In FIG. 6*b*, the ratio of W:H is 3.33. The electric field in each case has a good degree of uniformity which prevents or significantly reduces the amount of distortions during the tilt correction.

FIG. 6*c* shows, for comparison, a tilt corrector with electrodes having a circular cross-section. Here, the electrical field has many perturbations.

We claim:

1. A time of flight (TOF) ion beam front tilt corrector, comprising:

at least one electrode which, when supplied with a voltage, defines a substantially equipotential channel, the channel extending in a longitudinal direction $Z_{TC}$, the channel further extending a first, longer distance along a first transverse axis $X_{TC}$ defined perpendicular to the longitudinal direction $Z_{TC}$, and a second, shorter distance along a second transverse axis $Y_{TC}$, perpendicular with both the first axis $X_{TC}$ and the longitudinal axis $Z_{TC}$, wherein the ratio of the first, longer distance along the first axis $X_{TC}$ to the second, shorter distance along a second axis $Y_{TC}$ is at least 2;

wherein the length of the channel in the longitudinal direction $Z_{TC}$ varies in accordance with the transverse position in the direction $X_{TC}$ orthogonal to the longitudinal direction $Z_{TC}$ of the channel, so that ions at a first transverse position $X_{TC}$ in the ion beam spend a different amount of time traversing the channel of the at least one electrode, to ions in a second, different transverse position $X_{TC}$ of the ion beam, and the voltage supplied to the electrode allows for correction of misalignment of a beam front of the ion beam.

2. The TOF ion beam front tilt corrector of claim 1, wherein the ratio of the first, longer distance along the first transverse axis $X_{TC}$ to the second, shorter distance along the second transverse axis $Y_{TC}$ is between 2 and 10.

3. The TOF ion beam front tilt corrector of claim 2, wherein the ratio of the first, longer distance along the first transverse axis $X_{TC}$ to the second, shorter distance along the second transverse axis $Y_{TC}$ is between 2.4 and 7.

4. The TOF ion beam front tilt corrector of claim 3, wherein the ratio of the first, longer distance along the first transverse axis $X_{TC}$ to the second, shorter distance along the second transverse axis $Y_{TC}$ is between 2.7 and 5.

5. The TOF ion beam front tilt corrector of claim 1, wherein one or both of the inner surface or the outer surface of the at least one electrode comprises parallel planes in the $X_{TC}$-$Z_{TC}$ plane.

6. The TOF ion beam front tilt corrector of claim 5, wherein the channel of the at least one electrode or the at least one electrode has a rectangular cross-section in the $X_{TC}$-$Z_{TC}$ plane.

7. The TOF ion beam front tilt corrector of claim 1, wherein the channel defined by the at least one electrode is wedge-shaped in the $X_{TC}$-$Z_{TC}$ plane.

8. The TOF ion beam front tilt corrector of claim 1, wherein the channel has an ion entrance opening and an ion exit opening spaced from each other in the longitudinal direction $Z_{TC}$, both openings lying in planes parallel to the axis $Y_{TC}$ and being tilted with respect to each other at an angle $\alpha(\neq 0)$.

9. The TOF ion beam front tilt corrector of claim 8, wherein a is between 10° and 50°, and preferably between 20° and 40°.

10. The TOF ion beam front tilt corrector of claim 7, including first and second wedge-shaped electrodes positioned adjacent to each other such that the channels defined by the first and second wedge-shaped electrodes align in the $X_{TC}$ and $Y_{TC}$ directions.

11. The TOF ion beam front tilt corrector of claim 10, wherein the ion exit opening of the first wedge-shaped electrode and the ion entrance opening of the second wedge-shaped electrode each lie in planes parallel to one another.

12. The TOF ion beam front tilt corrector of claim 1, wherein the channel has an ion entrance opening and an ion exit opening spaced from the ion entrance opening in the longitudinal direction $Z_{TC}$, the surface of at least one of these openings being extended in the $Y_{TC}$ direction and defined by a curved line in the $X_{TC}$-$Z_{TC}$ plane so as to form a curved electrode's face.

13. The TOF ion beam front tilt corrector of claim 12 including first and second adjacent opposed curved electrodes whose channels align in the $X_{TC}$ and $X_{TC}$ directions.

14. The TOF ion beam front tilt corrector of claim 13, wherein the ion exit opening of the first curved electrode and the ion entrance opening of the second curved electrode each define a curved surface, wherein the separation between the curved surfaces of the ion entrance opening and the ion exit opening remains substantially constant in the longitudinal direction Z, and wherein the ion exit opening of the first curved electrode faces the ion entrance opening of the second curved electrode.

15. The TOF ion beam front tilt corrector of claim 1, further comprising one or more electrodes defining a channel having a first opening lying in the $X_{TC}$-$Z_{TC}$ plane perpendicular to the longitudinal direction $Z_{TC}$, and a second opening spaced from the first opening in the direction but also lying in the $X_{TC}$-$Z_{TC}$ plane perpendicular to the longitudinal direction $Z_{TC}$, such that the planes of the first and second openings are parallel with one another.

16. An ion detection system, comprising:

a time of flight (TOF) ion beam front tilt corrector having:

at least one electrode which, when supplied with a voltage, defines a substantially equipotential channel, the channel extending in a longitudinal direction $Z_{TC}$, the channel further extending a first, longer distance along a first transverse axis $X_{TC}$ defined perpendicular to the longitudinal direction $Z_{TC}$, and a second, shorter distance along a second transverse axis $Y_{TC}$, perpendicular with both the first axis $X_{TC}$ and the longitudinal axis $Z_{TC}$, wherein the ratio of the first, longer distance along the first axis $X_{TC}$to the second, shorter distance along a second axis $Y_{TC}$ is at least 2, wherein the length of the channel in the longitudinal direction $Z_{TC}$ varies in accordance with the transverse position in the direction $X_{TC}$ orthogonal to the longitudinal direction $Z_{TC}$ of the channel, so that ions at a first transverse position $X_{TC}$ in the ion beam spend a different amount of time traversing the channel of the at least one electrode, to ions in a second, different transverse position $X_{TC}$ of the ion beam, and the voltage supplied to the electrode allows for correction of misalignment of a beam front of the ion beam; and an ion impact detector spaced from the TOF ion beam front tilt corrector along the $Z_{TC}$ axis.

17. The ion detection system of claim 16, wherein the TOF ion beam front tilt corrector is positioned adjacent to the ion impact detector.

18. A TOF mass spectrometer comprising an ion source and the ion detection system of claim 16.

19. A method of correcting the tilt of an ion beam front in a time of flight (TOF) mass spectrometer, comprising:

(a) in an ion source, generating an ion beam having a beam axis $Z_I$ along a direction of travel in the TOF mass spectrometer, the ion beam having a width in a direction along a first transverse axis $X_I$ in an $X_I$-$Y_I$ plane perpendicular to the $Z_I$ axis and a height in a direction along a second transverse axis $Y_I$ perpendicular to the first transverse axis $X_1$ in the $X_1$-$Y_1$ plane, wherein the width of the ion beam is larger than the height of the ion beam;

(b) directing the ion beam towards an ion detector at a location in the TOF mass spectrometer downstream of the ion source;

(c) directing the ion beam through a TOF ion beam front tilt corrector located between the ion source and the ion detector, the TOF ion beam front tilt corrector comprising at least one electrode defining a channel extending longitudinal a $Z_{TC}$ axis and also in the $X_{TC}$-$Y_{TC}$ plane perpendicular to the $Z_{TC}$ axis, the length of the channel in the $Z_{TC}$ axis direction varying in accordance with the position in the channel in the perpendicular $X_{TC}$-$Y_T$ plane and the channel extends a first, longer distance along a first transverse axis $X_{TC}$ in the $X_{TC}$-$Y_{TC}$ plane and a second, shorter distance along a second transverse axis $Y_{TC}$ perpendicular to the first transverse axis $X_{TC}$ in the $X_{TC}$-$Y_{TC}$ plane, wherein the ratio of the first, longer distance along the first transverse axis $X_{TC}$ to a second, shorter distance along a second transverse axis $Y_{TC}$ is at least 2; and (d) applying a voltage to the at least one electrode of the TOF ion beam front tilt corrector, so as to generate a substantially equipotential channel defined by the electrode, whereby ions in the ion beam at different locations in the $X_{TC}$-$Y_{TC}$ plane experience the substantial equipotential in the electrode channel for different lengths of time as they pass through the channel, so as to shift the locus of the plane of the ion beam front relative to the $Z_{TC}$ axis as ions pass through the TOF ion beam front tilt corrector, and the voltage applied to the electrode of the TOF ion beam front tilt corrector allowing for correction of misalignment of a beam front of the ion beam.

20. The method of claim 19, wherein the ratio of the first, longer distance along the first transverse axis $X_{TC}$ to the second, shorter distance along the second transverse axis $Y_{TC}$ is between 2 and 10.

21. The method of claim 20, wherein the ratio of the first, longer distance along the first transverse axis $X_{TC}$ to the second, shorter distance along the second transverse axis $Y_{TC}$ is between 2.4 and 7.

22. The method of claim 21, wherein the ratio of the first, longer distance along the first transverse axis $X_{TC}$ to the second, shorter distance along the second transverse axis $Y_{TC}$ is between 2.7 and 5.

* * * * *